US005385247A

United States Patent [19]

Owens

[11] Patent Number: 5,385,247

[45] Date of Patent: Jan. 31, 1995

[54] FIREWOOD RACK

[76] Inventor: Ralph T. Owens, 11 Sheffield Ave., Spotswood, N.J. 08884

[21] Appl. No.: 101,747

[22] Filed: Aug. 4, 1993

[51] Int. Cl.[6] ..... A47F 7/00

[52] U.S. Cl. ..... 211/49.1; 211/60.1

[58] Field of Search ..... 211/49.1, 60.1, 189, 211/191, 71

[56] References Cited

U.S. PATENT DOCUMENTS

| | | | |
|---|---|---|---|
| 3,187,901 | 6/1965 | Wilson | 211/49.1 |
| 4,333,574 | 6/1982 | Christy, Sr. | 211/60.1 |
| 4,600,108 | 7/1986 | Scott et al. | 211/49.1 |
| 4,616,757 | 10/1986 | Hobson | 211/60.1 X |
| 4,765,491 | 8/1988 | Mueller | 211/49.1 |
| 4,971,207 | 11/1990 | Baucom | 211/49.1 |

*Primary Examiner*—Alvin C. Chin-Shue
*Assistant Examiner*—Sarah L. Purol
*Attorney, Agent, or Firm*—Charles I. Brodsky

[57] ABSTRACT

An easily assemblable, disassemblable firewood rack incorporating a bottom base structure, a top cover structure, left and right-side cross supports and a plurality of tubings snugly fit into the side cross supports to allow for a standing of the rack off the ground, and in a manner to restrict outward bowing under the weight of stored firewood. The front of the top cover structure is constructed higher than its back to provide a pitch for rearward run-off of rain and snow striking the cover, selected of any desired compositional material.

13 Claims, 2 Drawing Sheets

FIREWOOD RACK

FIELD OF THE INVENTION

This invention relates to a firewood rack and, more particularly, to one which is easy to assemble and to disassemble.

BACKGROUND OF THE INVENTION

As is well known and understood, the most prevalent way of storing firewood is to stack it up in the yard, usually between two large trees. As is also well known and understood, even if covered with a tarpaulin, over time, the firewood so stored becomes rotted, decayed, or infested with insects—to the extent that much of it is either thrown out as garbage, or discarded as part of a general spring clean-up. In those instances, on the other hand, where the firewood is not adequately covered, the process of decay is speeded up by wind, rain and snow—or one just often finds the wood to be unduly wet, or just serving as a haven for termites and other insects.

Several attempts have been suggested to correct these problems—but have been found to be generally unacceptable—the metal "hoops" (which often sit on a porch or deck) are primarily decorative and limited in storage capacity; the metal tubular-open arrangements are likewise of limited capacity and, when constructed of metal, like the "hoop arrangement" tend to rust in only 2–3 years. Even when newly purchased, such available items are not adequately covered, as the plastic bags, polyurethane sheets and tarpaulins merely thrown over them tend to blow-about with the wind, and even when held down with weights, produces puddles and leaks. If these constructions, on the other hand, are stood in the yard instead of on the porch, then it has been found that the bottom rows continue to be saturated with wetness, insect infestation and with mushrooms or other fungi growing. Obviously, stacking the firewood near the house—with or without these "hoop" or "tubular" fabrications—invites termite damage to the house, and stacking the firewood between trees or saplings has been seen to damage the bark and/or the roots, as well as interfering with the normal growth pattern.

OBJECTS OF THE INVENTION

It is an object of the present invention, therefore, to provide a new and improved firewood rack which overcomes the problems existent with the prior art.

It is another object of the invention to provide such a firewood rack which is easy to assemble and to disassemble.

It is a further object of the invention to provide such a firewood rack which can adequately hold a ½ cord of wood and more.

It is yet another object of the invention to provide this type of firewood rack purchasable as a kit, and which can easily be put-together, primarily only with a hammer and/or screwdriver.

It is an additional object of the invention to provide such a firewood rack with easily obtainable materials.

SUMMARY OF THE INVENTION

As will become clear from the description that follows, an easily assemblable, disassemblable firewood rack incorporates a bottom base structure, a top cover structure, left and right-side cross supports (all constructed of readily available lumber) and a plurality of metal tubings snugly fit into the side cross supports to allow for a standing of the rack off the ground, and in a manner to restrict outward bowing under the weight of the stored firewood. As will also be described, the front of the top cover structure is constructed higher in elevation than its back, so as to provide a pitch for rearward run-off of any rain and snow which strikes the cover, and which may be selected of any desired compositional material, such as canvas, tarpaulin, corrugated plastic, shingling, etc. In a further embodiment of the invention, a separate section for storing kindling is provided, and with the dimensions set forth, affords a firewood rack some 8 feet long, some 6 feet high in storing a ½ cord of wood thus allowing the rack to stand as a separate fence-type structure. As will be seen, to restrict the outward bowing of the rack under such weight of firewood, the metal tubings employed snugly fit within the side cross supports. A pair of concrete, or cinder-blocks may be purchased by the owner to support the rack totally above the ground, and to thereby further protect the firewood from wetness and insects, while at the same time allowing for adequate ventilation through the bottom and sides of the firewood rack.

BRIEF DESCRIPTION OF THE DRAWING

These and other features of the invention will be more clearly understood from a consideration of the following description, taken in conjunction with the accompanying drawing, in which.

DETAILED DESCRIPTION OF THE DRAWINGS

Figure 1:
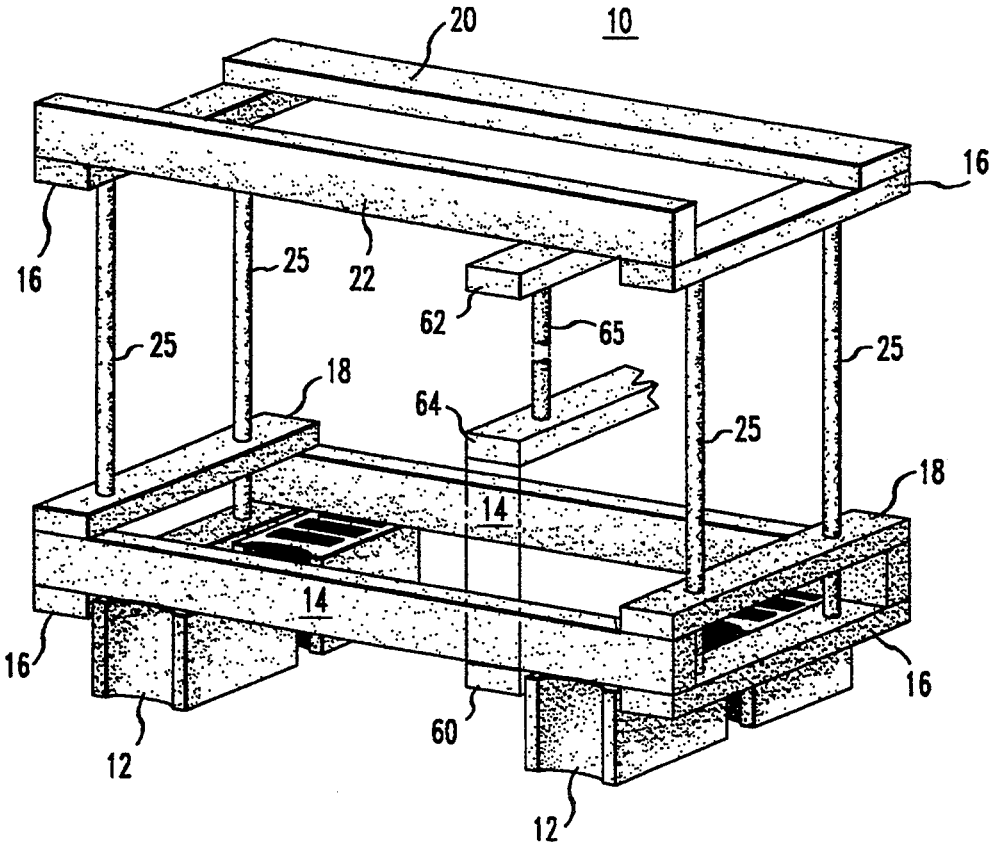
FIG. 1 is a front perspective view of a firewood rack constructed in accordances with the teachings of the present invention.

In the drawing, the firewood rack 10 rests atop a pair of concrete or cinder-blocks 12 and incorporates a base structure having a pair of parallel members 14 constructed of 2"×6" Wolmanized lumber, provided some 8 feet in length. Two pairs of side cross supports 16, 18 are provided to maintain this parallel relationship, by being nailed or screwed to the underside and topside of the members 14, at their respective ends. (In one manufacture of the invention, "screw-holes" can be initially provided where the firewood rack would be provided as a kit to be assembled by a purchaser, along with the appropriate numbers of screws, or nails necessary to assemble the firewood rack.)

Also shown in the drawing are two additional structural members 20, 22 also arranged in parallel relationship and nailed (or screwed) to maintain such orientation through another pair of side cross supports 16. More particularly, and as shown, these members may be constructed of 2"×4" Wolmanized lumber of 8 foot length, with the first, or back, member 20 being arranged to lay "flat" oN the cross support 16 and with the second, or front, member 22 standing on its end, so that this front member 22 is of a higher elevation than the back member 20 in providing the top structure for the firewood rack 10.

Figure 2:
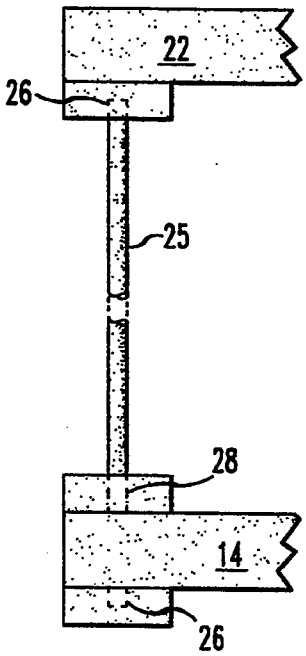
FIGS. 2, 3*a*, 4, 5*a*, 5*b* and 5*c* are illustrations helpful in an understanding of the construction of the embodiment of FIG. 1.

To facilitate the assembly, four metal tubings 25 are illustrated. As shown in FIGS. 1 and 2, the tubings 25 fit within countersunk holes 26 of substantially like-diameter provided in the side cross supports 16 and pass through substantially like-diameter apertures 28 provided in the side cross supports 18. Consequently, a snug fit results with the tubing 25—which for a rack storing a ½ cord of wood, would be selected of a 5 foot length. In this preferred embodiment of the invention ¼ inch diameter thin wall conduit was employed for the tubing 25 although any appropriate material or diameter could obviously be used as an alternative. In maintaining the described relationship, it will be appreciated that the cross supports 16, 18 perpendicularly align with the members 14, 20, 22 in keeping them parallel and in a pleasantly attractive configuration.

Figure 3A:
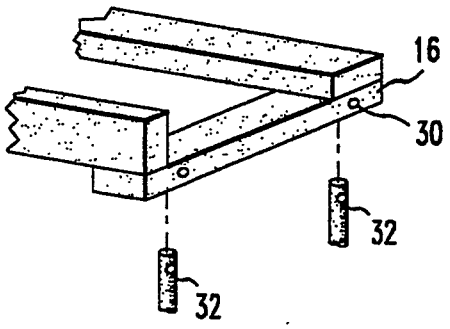
Figure 3B:
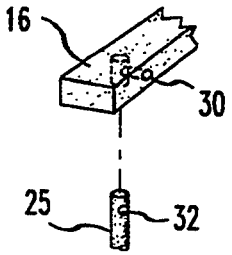

FIGS. 3*a* and 3*b* are helpful in an understanding of other features of the invention. First of all, the snug fit between the tubing 25 with the holes 26 and aperture 28 is sufficient with the rigid nature of the tubing 25 to support most weights of stored firewood, with only a minimum tendency for any "bowing" outwardly as the stack increases in the amount of wood stored.

Figure 4:
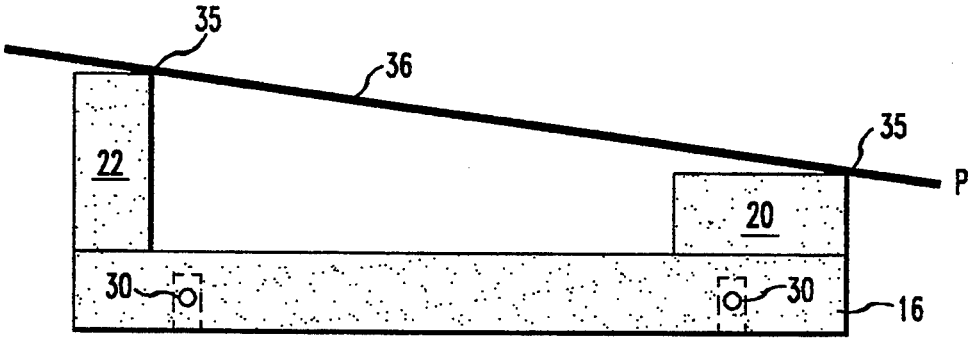

Another feature of the arrangement of FIGS. 3*a* and 3*b* is in the covering of the firewood rack 10 so as to protect it from rain and snow—front, back and top—while continuing to allow for an air flow through the sides. More particularly, and observing the pitch "P" which follows from standing the member 22 on its end while laying the member 20 flat, a front-to-back flow of rain and snow will be seen to follow (FIG. 4).

Thus, with the side cross support being of a 16" nominal length, a 1:8 pitch roughly results when using 2×4 lumber with the members 20, 22 arranged as set forth, a gradual and sufficient amount to allow for run-off to follow. Reference notation 35 indicates the points at which a cover 36 is to be nailed or otherwise secured, when constructed of a rigid material such as plywood or corrugated vinyl.

Figure 5A:
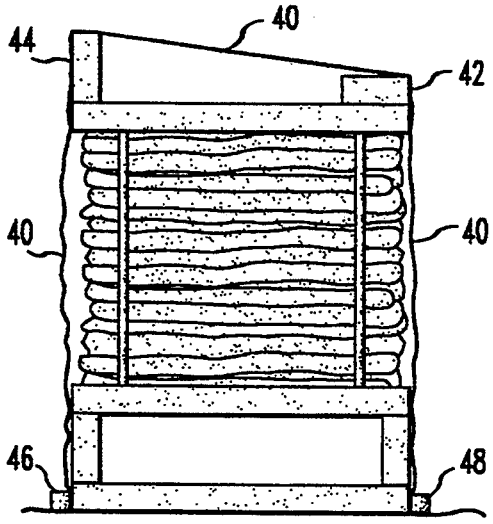
Figure 5B:
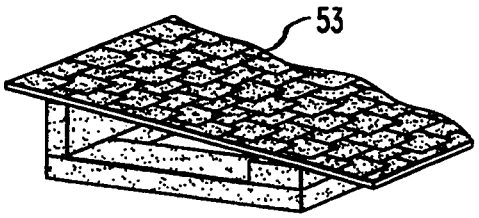
Figure 5C:
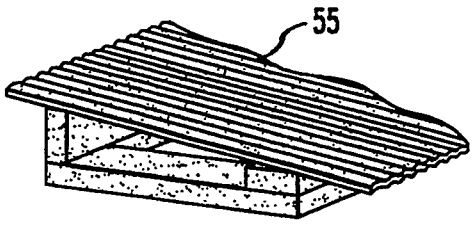

FIGS. 5*a*–5*c* schematically show these various types of covers that may be employed for the firewood rack 10. Thus, in FIG. 5*a*, a polyurethane sheet 40 is shown, which can be stapled to the rear of the member 20 at 42 and to the front of member 22 at 44. A wooden strip 46, or other weight, can be secured to the bottom of the polyurethane 40 to afford a weight to keep the cover from lifting under forces of the wind, and can similarly be provided at the location 48 at the back of the cover, or the back could be stapled or otherwise secured to the rear of the back member 14, instead. With such arrangements, the polyurethane cover 40 can hang down tightly, and can be lifted to access the stored firewood (FIG. 5*a*). Although a similar arrangement can be employed with canvas and tarpaulin, this arrangement with the polyurethane cover 40 is the most economical and provides best visibility to determine the amount of stored firewood remaining, while continuing to keep rain and snow from the top, front and rear of the firewood rack. As an alternative method of securement "bungee" cords can be employed to hold the bottom of these covers in position.

FIGS. 5*b* and 5*c* illustrate other possible covers—FIG. 5*b* illustrating the use of plywood, or plywood-covered shingling, 53, as a roof to match, where desired, whatever covering exists on the house. FIG. 5*c*, on the other hand, employs corrugated plastic, such as vinyl 55 available in various colors, patterns, and sizes, and easy to install. Both versions of FIGS. 5*b* and 5*c*, however, will be understood as substantially only affording a cover to the top of the firewood rack, and not to its front and rear sides.

An additional feature of the construction of FIGS. 3*a* and 3*b* is in preventing any strong gust of wind lifting and blowing away a rigidly constructed cover 36. Thus, a drill-hole 30 is provided within the top cross support 16, countersunk, to receive a fastening screw (not shown) arranged to mate with a comparably provided hole 32 in the tubing 25. Such fastening screw (#6×1½") is inserted through the side of the cross-piece, and at a position 3/8"or ½" from the bottom of the support 16. As will be readily apparent to those skilled in the art, this arrangement will retain the top structure as described above, and the cover 36, in position. Either a wood screw or sheet metal screw is appropriate, and also acts in a direction to reinforce and virtually eliminate any outward bowing of the tubing 25.

A further feature of the invention is schematically shown in FIG. 1 as allowing for the construction of a separate section, within the firewood rack 10 to store kindling. Three additional side cross supports are employed, 60, 62, 64, and a pair of tubings 65, only one of which is shown. In particular, the cross supports 60, 62 may be fabricated identically to the lower and top side cross support 16, respectively, while the side cross support 64 may be constructed identically to the support 18. WheN secured with the members 14, 20, 22 exactly as with the rack 10, and receiving the metal tubing 65 of a like fabrication to the tubing 25, these components facilitate the formation of a further 10 section, which may be offset some 10" or so from either the left or right-sides of the firewood rack 10, in allowing for the storage of kindling. Because a rigidly constructed cover is already secured from being blown off, it will be appreciated that no need really exists to drill and screw into the tubing 65 through the side cross support 62.

As will be readily appreciated, an optimum construction of the invention is one in which the base structure is laid down level both left-to-right, and, particularly, front-to-back, as along the cross members 16 and 18. Such leveling will be understood to insure vertical and plumb stacking, and acts to reduce any tendency to lean either to the sides, to the front, or to the back, in thus establishing a stability for the rack. As an added, optional precaution for stability, the rack of the invention also incorporates one or more stakes, of suitable composition, driven into the ground mid-way along the length of the rear member 14, or at any desired position(s). Such stakes could be secured to the rear member 14 in any appropriate manner, and will be seen to afford enhanced front-to-back stability to the construction.

As will be readily apparent, the firewood rack as described above can be easily assembled and disassembled—literally in minutes—and can be easily moved or shipped with household goods. Once put together, on the other hand, it forms a solid construction, yet allowing for air flow over, under and through the sides of the stored firewood. With firewood of two foot length—which can be easily stored on the members 14 with 16" side cross supports—a ½ cord of wood can be stored in an 8 foot long section for the rack. Obviously, with 10, 12 or 16 foot lengths, not only can more firewood be stored, but the rack 10 could then take on the likeness of a yard fence. With a 16 foot span, for example, to hold a cord of wood, a further concrete or cinder block support may be provided midway between the two end blocks 12, along with additional tubing sections akin to that for storing kindling. In either event, it will be apparent that the more the firewood rack is put together with the use of wood screws—as compared to nails—the easier it will be to disassemble the rack for shipment in the event where a person moves from one house to another.

While there have been described what are considered to be preferred embodiments of the present invention, it will be readily appreciated by those skilled in the art that modifications can be made without departing from the scope of the teachings herein. For example, any desired dimensions can be selected for forming the firewood rack, and any appropriate materials can be utilized instead of the lumber and metal tubings set forth. Whereas such components can be easily obtained in most any lumberyard, or from any building supply store, other materials might be selected if intended to coordinate better with the decor of the house whose fireplace is to burn the stored firewood. For at least such reasons, therefore, resort should be had to the claims appended hereto for a true understanding of the scope of the invention.

I claim:

1. A firewood rack comprising.:

a bottom base structure;

a top cover structure;

sets of left and right-side cross supports for said bottom and top structures; and a plurality of tubings snugly fit into said side cross supports to restrict outward bowing of said rack under the weight of stored firewood; and wherein said top cover structure includes a first portion constructed of greater height than a back portion of said top cover structure; and an openable cover across said top cover structure and extending downwardly therefrom between said left and right-side cross supports.

2. The firewood rack of claim 1, wherein said cover is releasably securable at said front and back portions of said bottom cover structure.

3. The firewood rack of claim 1, also including means extending into said sets of cross supports for securing said plurality of tubings in place.

4. The firewood rack of claim 1, also including an additional set of cross supports for said bottom and top structures, positioned between said sets of left and right-side cross supports, and a further plurality of tubings snugly fit into said additional set of cross supports.

5. The firewood rack of claim 4, also including means extending into said additional set of cross supports for securing said further plurality of tubings in place.

6. The firewood rack of claim 4, wherein said additional set of cross supports is positioned nearer one of said left and right-side cross supports than the other.

7. The firewood rack of claim 1, also including a pair of cinder blocks for supporting said bottom base structure.

8. A firewood rack comprising:

first, second, third and fourth structural members of predetermined length;

means supporting each of said first and second members in parallel alignment;

first and second cross supports perpendicularly aligned with said first and second members at the opposite ends thereof, and secured to said first and second members at an underside thereof;

third and fourth cross supports perpendicularly aligned with said first and second members at the opposite ends thereof, and secured to said first and second members at a topside thereof;

fifth and sixth cross supports perpendicularly aligned with said third and fourth members at the opposite ends thereof, and secured to said third and fourth members at an underside thereof;

pairs of countersunk holes in a top surface of each of said first and second cross supports;

a pair of apertures in each of said third and fourth cross supports;

pairs of countersunk holes in a bottom surface of each of said fifth and sixth cross supports;

and four vertical tubing supports extending between said countersunk holes in said first, second, fifth and sixth cross supports and through said apertures in said third and fourth cross supports.

9. The firewood rack of claim 8, wherein said third member is of a higher elevational level above said fifth and sixth cross supports than is said fourth member.

10. The firewood rack of claim 9, also including a cover across said third and fourth members extending between said fifth and sixth cross supports.

11. The firewood rack of claim 9, also including an openable cover across said third and fourth members and extending downwardly between said third and fourth cross supports at the opposite ends thereof.

12. The firewood rack of claim 9, also including means extending into side portions of said fifth and sixth cross supports to secure said four vertical tubing supports in place.

13. The firewood rack of claim 9, also including:

a seventh cross support perpendicularly aligned with said first and second members adjacent to one of said first and second cross supports, and secured to said first and second members at an underside thereof;

an eighth cross support perpendicularly aligned with said first and second members adjacent to one of said first and second cross supports, and secured to said first and second members at a top side thereof;

a ninth cross support perpendicularly aligned with said third and fourth members adjacent to one of said first and second cross supports, and secured to said third and fourth members at an underside thereof;

pairs of countersunk holes in a top surface of said seventh cross support;

pairs of apertures in said eighth cross support;

pairs of countersunk holes in a bottom surface of said ninth cross support; and two vertical tubing supports extending between said countersunk holes in said seventh and ninth cross supports and through said eighth cross support.

* * * * *